United States Patent [19]

Barr

[11] 4,033,276

[45] July 5, 1977

[54] SUPPORT FOR LIFE RING AND ASSOCIATED RETRIEVAL LINE

[75] Inventor: Douglas Barr, Cambridge, Mass.

[73] Assignee: Engineered Safety Products, Inc., West Warwick, R.I.

[22] Filed: Sept. 7, 1976

[21] Appl. No.: 720,932

[52] U.S. Cl. ..... 114/190; 9/14; 242/85.1; 248/316 A

[51] Int. Cl.[2] ..... B63C 9/22

[58] Field of Search ..... 114/190; 9/14; 43/43.11, 27.4; 242/85.1; 248/309 R, 316 A, 89, 90, 91

[56] References Cited

UNITED STATES PATENTS

| | | | |
|---|---|---|---|
| 1,728,106 | 9/1929 | Collins | 242/85.1 |
| 1,773,462 | 8/1930 | Lambdin | 114/190 |
| 2,690,152 | 9/1954 | Riccio | 114/190 |
| 3,099,845 | 8/1963 | Chamberlain | 114/190 |

FOREIGN PATENTS OR APPLICATIONS

| | | | |
|---|---|---|---|
| 736,565 | 11/1932 | France | 248/316 A |

*Primary Examiner*—Trygve M. Blix
*Assistant Examiner*—Charles E. Frankfort
*Attorney, Agent, or Firm*—Robert J. Doherty

[57] ABSTRACT

A support is disclosed for retaining a life ring and its associated line in a ready position for emergency use and includes a frame having vertically slidable portions adapted to be held in a spaced apart open position by the insertion of the life ring between outwardly extending members thereof and adapted to move towards each other when the life ring is removed therefrom so as to reduce the overall height of the frame member and thus enable a retaining line coiled thereabouts in a relatively taut storage attitude to be loosely suspended from the top portion thereof in a relatively closed or emergency use position.

13 Claims, 11 Drawing Figures

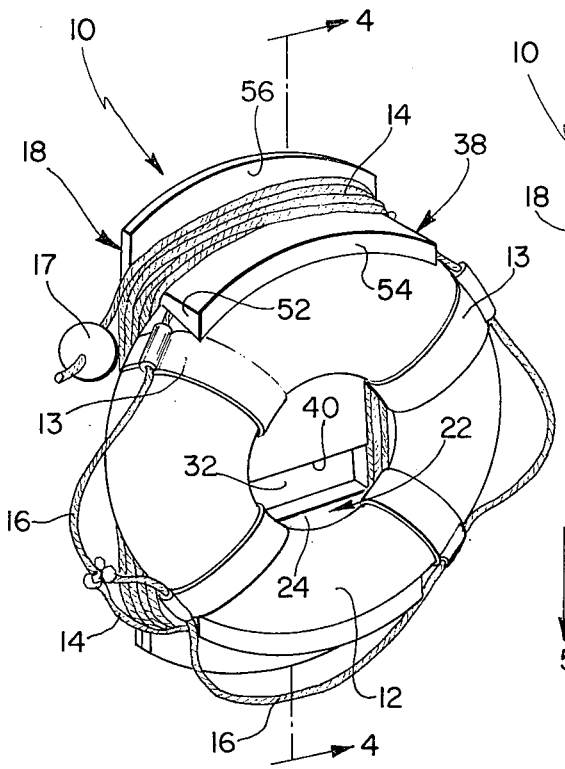
FIG. 1
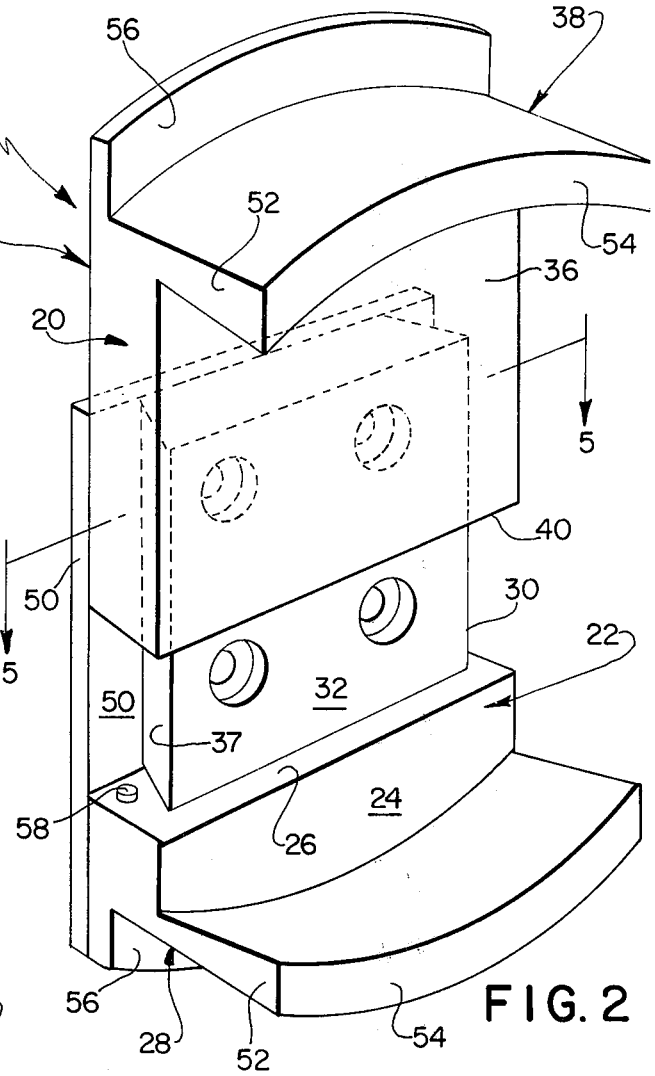
FIG. 2
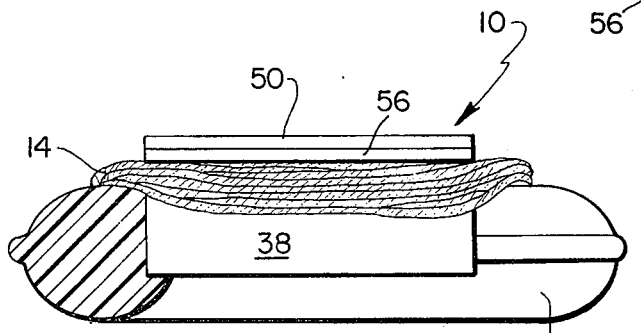
FIG. 3
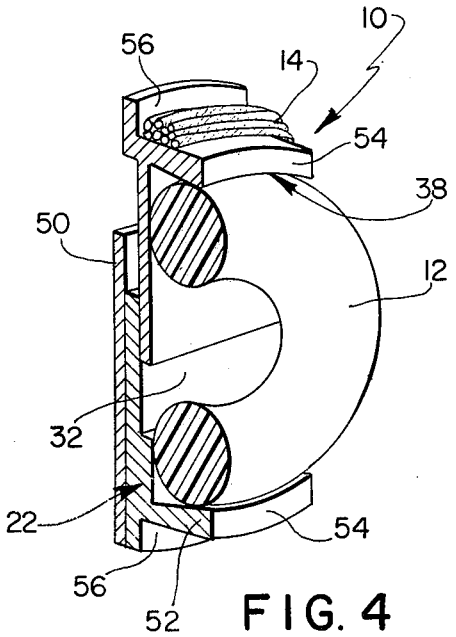
FIG. 4
FIG. 5
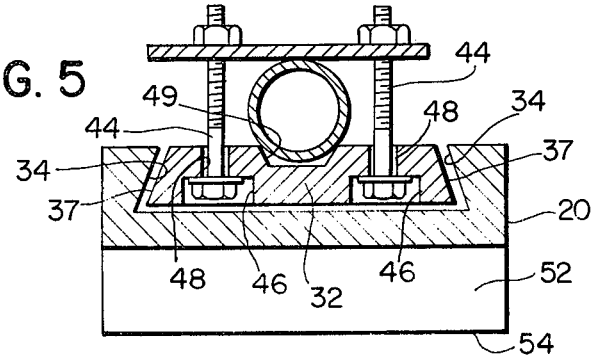

SUPPORT FOR LIFE RING AND ASSOCIATED RETRIEVAL LINE

BACKGROUND OF THE INVENTION

This invention relates generally to life saving apparatus and has particular reference to a device for holding both a life ring and its associated retaining line in precoiled attitude for instant use. during an emergency. Such life saving equipment is found on boats, docks and other installations on the water and usually includes a ring buoy hung at various locations in readiness to be thrown to a person who has fallen overboard or is otherwise in distress near the boat or installation. Usually when such an emergency situation occurs, the ring buoy must be instantly ready for use and there is not time for complicated preparation or laborious assembly of equipment. The retrieval line normally provided is generally essential for pulling the person in distress towards the boat or installation or for retrieving an improperly thrown ring buoy for a subsequent try.

Many such holders either for the ring buoy itself or for its associated line exist and include such devices that provide supports solely for the ring buoy such as disclosed in U.S. Pat. No. 583,221 issued may 25, 1897 and British patent specification No. 107,853 issued July 19, 1917 and those which provide for the support of both the life ring and its associated retrieval line such as U.S. Pat. No. 2,260,109 issued Oct. 21, 1941 and U.S. Pat. No. 2,690,152 issued Sept. 28, 1954. Such prior art devices generally are however somewhat complex in their operational modes and in many cases required the associated retainer line to be precoiled about a drum or other feeding mechanism which reduces the flexibility of the device and in some cases needlessly increases its complexity. Other prior art devices provide either no retention means for the coil line or a simple mechanism remote from the life ring support. In all such cases it would be more desirable to be able to place such line in coiled position in such a manner associated with the life ring holder so that when the life ring holder is removed therefrom the coiled line is readily available and in an uncomplicated flexible position so that the person assisting in the emergency situation can best determined the manner in which such situation will be met without need for review or study of complex operating mechanisms. It will further be desirable to permit one handed removal of the life ring so that the other hand would be available for grasping the associated line in a standard toss position.

It is thus an object of the present invention to provide a life ring holder which not only supports a life ring in ready use for an emergency situation but also supports a coiled length of associated retainer line in a similar ready position in such a manner that when the life ring is removed therefrom the line is available for simultaneous use in connection therewith.

A further object of the present invention is the provision of a combination life ring and associated retainer line support wherein emergency functioning thereof is obvious when grapsing the life ring for emergency use and thereafter its operation is automatic so as to free the associated coiled retainer line for immediate use.

Another object is the provision of a combination holder of the aforementioned type wherein the life ring supported thereby may be simply removed in one handed operation by the user.

A still further object of the present invention is the provision of a combination holder for a life ring and its associated coil retainer line of the type above described in which an alarm generally hidden from view so as to reduce tampering therewith is activated by the movement of such support from an open storage position to a relatively closed emergency use position.

Still another object of the invention is the provision of a life ring support which will accommodate a wide variety of life ring sizes to accordingly eliminate or reduce the need to provide each size life ring with a different size support.

These and other objects of the present invention are accomplished by the provision of a combination support including a frame adapted for mounting in a generally vertical disposition and having upper and lower portions thereof, each portion having an outwardly extending member adapted for retaining contact with portions of a ring buoy and movable with respect to each other from an open storage position wherein the line associated with such ring buoy is coiled in a relatively taut disposition thereabout the frame to a closed use position where the life ring has been removed from the frame and the coiled line is loosely supported thereby.

Other objects, features and advantages of the invention will become apparent when the description thereof proceeds when considered in connection to accompanying illustrative drawings.

DESCRIPTION OF THE DRAWINGS

In the drawings which illustrate the best mode presently contemplated for carrying out the present invention:

FIG. 1 is a perspective view of the support of the present invention with a life ring and its associated retrieval line positioned therewith as contemplated;

FIG. 2 is a perspective view of the supporting frame of the present invention in a somewhat open position with the life ring and line removed for clarity;

FIG. 3 is a top view of FIG. 1 with a portion of the life ring and line illustrated in section;

FIG. 4 is a sectional view taken along the line 4—4 of FIG. 1;

FIG. 5 is a sectional view taken along the line 5—5 of FIG. 2;

DESCRIPTION OF THE INVENTION

Figure 6:
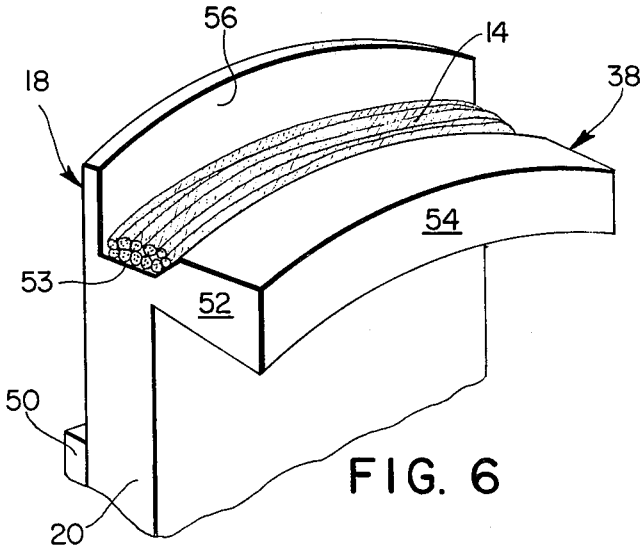
FIg. 6 is a partial perspective view showing another embodiment of the invention.

Turning now to the drawings and particularly FIG. 1 thereof, a support 10 adapted to support a life or ring buoy 12 is shown. The ring buoy 12 is provided with its usual becket 13 and a line of rope 14 which may be maintained in a coiled position thereabout as will be more evident hereinafter. The line 14 is connected at one end thereof to the grab line 16 and either free at the other end or provided with a loop or marking device such as ball 17.

The support 10 as best illustrated in FIG. 2 includes a frame 18 which in turn is comprised of separate upper and lower frame portions designated by the reference numerals 20 and 22 respectively. Such frame portions 20 and 22 are positioned for relative i.e. vertical motion between each other from an open or extended position which is depicted in FIG. 1 in which the life ring and associated line is maintained in a storage position to a closed or use position which will be hereinafter more apparent. Such use position is automatically assumed by the frame 18 once the life ring 12 has been removed therefrom so as to place such in a ready or emergency use position wherein the length of coiled line 14 is available in a loosely supported condition therefrom.

The lower frame portion 22 includes a body 24 in turn having an inner surface 26, an outer surface 28 and a slide member 30 having a front face 32 and rearwardly inwardly directed sides 37 so as to assume a wedge-shaped cross sectional configuration. Such slide member 30 upwardly extends from the inner surface 26 of the lower frame portion 22. The upper frame portion 20 on the other hand includes a body 36, an outer surface 38 and an inner face 40. A channel or groove 34 is formed within the body 36 and is of a cross sectional configuration similar to that of slide 30 so that the two may interengage with each other and enable frame portion 20 and 22 so assembled to be vertically movable in relationship to one another. Normally the lower frame portion 22 is fixedly positioned in an upright position to a supporting surface such as a ship bulkhead, frame or post by means of bolts or other fasteners 44 positioned within sockets 46 provided in the face 32 of slide 30 and cooperating with openings or channels 48. A vertically orientated notch 49 may as illustrated in FIG. 5 be provided to facilitate post mounting. A shaft of the bolt 44 or other connection means may pass therethrough for connection with any of the aforementioned supporting surfaces from which the frame 18 is connected.

A back plate 50 may also be included on the lower portion 22 and extending upwardly from the inner surface 26 thereof at least a major portion of the extent of the slide 30 so that rear portions of the upper frame portion 20 engage such as the component parts of the frame function in slidable relationship. Such back plate 50 assures smooth slidable contact between the portions 20, 22 and prevents contact of the upper portion 20 with a bulkhead or other supporting surface which could offer undesirably high frictional contact. As it is contemplated that frame portions 20, 22 are to be formed from resinous compositions such as polyethylene, polypropylene, high impact polystyrene etc and formed into the shapes depicted by blow molding techniques, the back plate is depicted as separate but attached by any suitable means to the lower portion 22. If other forming techniques were utilized the plate 50 could be integral with or otherwise attached to portion 22.

The outer surfaces 28 and 38 of the lower and upper frame portions 22 and 20 respectively are each preferably of a relatively smooth configuration extending the entire width thereof so as to facilitate coiling of the line 14 therearound. Each frame portion 20, 22 is further provided with an outwardly extending member 52 having a front face 54 of angular configuration and of thickened proportions, the inner surfaces of which are adapted to engage outer peripheral portions of the life ring when placed therebetween. If desired the member 52 could be modified to include means for more positively engaging the life ring 12 if such was found to be necessary or desirable. Such means could include a downwardly extending retainer lip (not shown) of fairly narrow cross sectional configuration so as to be somewhat upwardly outwardly flexible so that the life ring 12 retained thereby and in contact therewith when removed therefrom can outwardly flex such retaining lips.

Figure 7A:
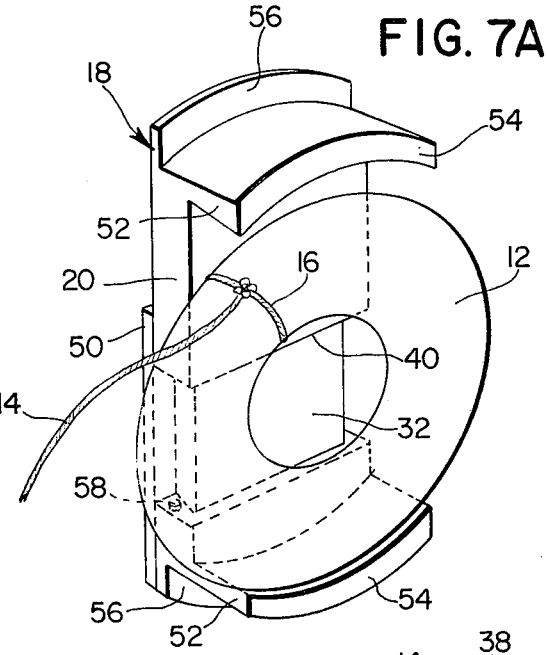
FIG. 7A–7E are perspective views showing the operational sequence of the support.
Figure 7B:
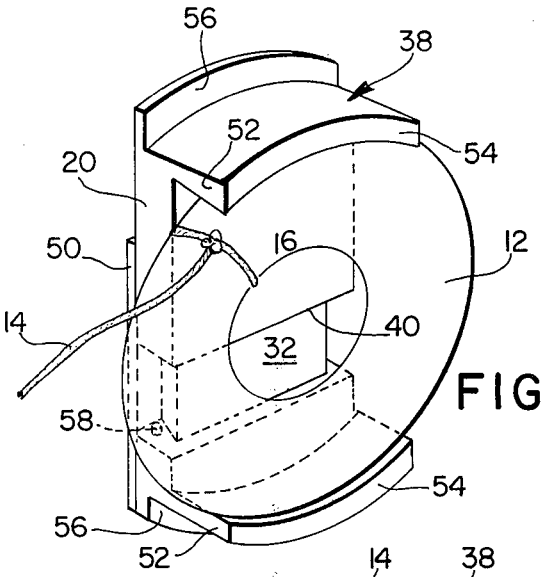
Figure 7C:
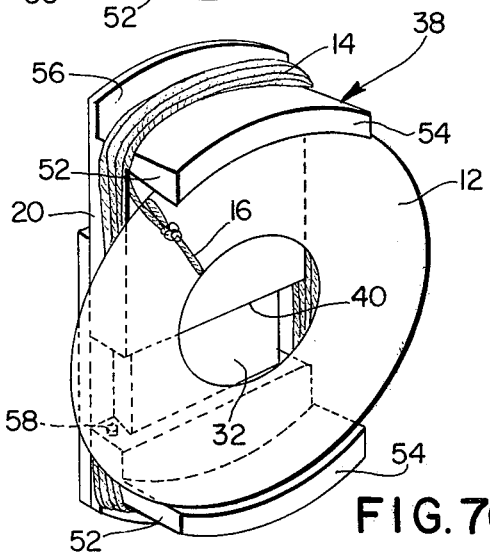
Figure 7D:
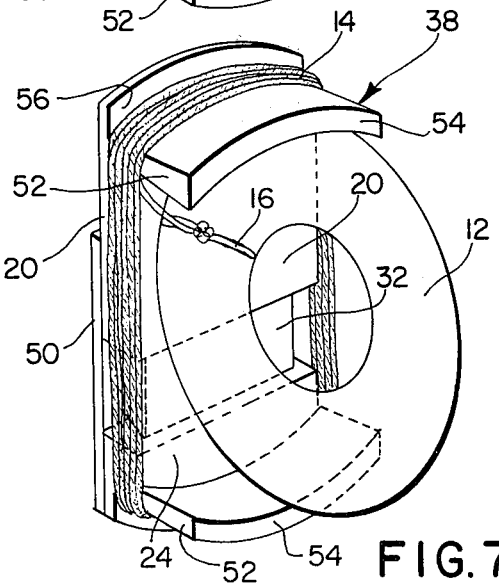
Figure 7E:
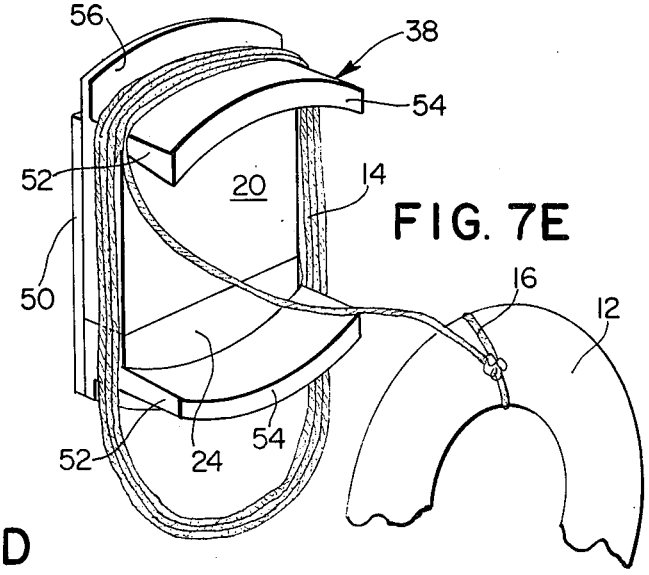

Operation of the support 10 is best explained by reference to the several views of FIG. 7. Wherein is shown in FIG. 7A thereof frame 18 in an extended, that is, open position receipt of the life ring 12 between the outwardly extending members 52 thereof. Thereafter as depicted in FIG. 7B, the upper frame portion 20 is permitted as by gravity to move toward the lower frame portion 22 until contact with the life ring 12 which is of relatively rigid construction prevents further movement and the life ring is held in place on the frame 18 by means of the retaining member 52 so that such cannot be removed inadvertently therefrom. It should also be noted at this time that such relative movement of the frame portions enables accommodation of a wide variety of life ring sizes. The line 14 may thereafter be coiled above the frame supported by surfaces 28 and 38 at the bottom and top respectively, by surface 56 at the back, and by the life ring 12 at the front as best shown by FIG. 3 of the drawings. Alternatively as shown in the embodiment depicted in FIG. 6 notches or grooves provided in such outer surfaces may be utilized to retain the line.

The free end of the line is either looped around the coil or otherwise fastened in place i.e. retention on a hook or other means (not shown) either associated with the frame 18 or upon the surface from which such is supported. In this position it is evident that the support 10 of the present invention provides a mechanism where both the life ring 12 and its associated line are conveniently stored in such a manner that when an emergency arises they are immediately available for use. In such extended or storage position neither the life ring nor the rope 14 can be removed accidentally.

Additionally the coiling action of the line 14 prevents any extensive upward movement of the upper frame portion 20 thus further assuring that the life ring retaining member 52 is maintained in place. Also the life ring 12 which is of relatively rigid construction, by reason of its placement between the retaining members 52 serves to maintain the frame portions 20 and 22 in a relatively open position which in turn maintains an adequate tension on the coil of line 14 so that it wont't accidentally slip either from behind the life ring or from the upper surfaces of retaining members 52.

When it is desired to use the life ring 12 held in the position above described, preferably the bottom of the life ring or grab line which is attached to beckets may be firmly grasped as with one hand and urged forwardly whereupon the frictional retention between the ring and the thickened portion of the retaining member 52 is overcome to allow removal thereof. Thereafter the upper frame portion 20 is free to downwardly slide in relationship to the lower portion 22 thereof, thus reducing the effective height of the frame 18 and consequently enabling the coil of rope 14 to extend loosely from the upper portion 20 in such a position that it may be grasped by the other hand preparatory to throwing the life ring.

Alternatively, both hands may be engaged in throwing the life ring 12 while the above construction allows the line to be played out directly from the support 10. In those cases where a line retaining notch 53 may be utilized it is desirable to provide a smooth transition between the rope receiving notch and the outwardly extending members 52 so that the rope will not become hung up thereon.

It should also be pointed out that the cooperating wedge-shaped configurations of the channel 42 and the slide 30 operable therein reduces any forward movement of the upper frame portion 20 in relation to the bottom portion 22. Furthermore this relationship enables the entire removal of the upper portion 20 should such be required. Additionally while it is clear that the present support is constructed to move from a storage position to a use or closed position by means of the gravity movement of the upper portion 20 towards the fixed bottom portion 22, it should be brought out that instead of gravity operation, the frame portions could be as urged towards each other by spring or other means and that in such case either the top portion 20 or the bottom portion 22 could be fixedly mounted from the supporting surface. Furthermore an alarm system may be housed within either of the portions 20, 22 or the surface to which the frame 18 is fixed so that upon the removal of the life ring 12, the movement of the frame 18 to its closed position will activate a member 58 to signal the presence of an emergency situation. The alarm is preferably auditory and is in the form of a bell or buzzer connected to a suitable source of energy such as a battery (not shown). While the activation device i.e. button 58 is shown positioned on the upper surface 26 of the lower frame portion 22 so that the downward movement of the other frame portion 20 will contact such, it should be clear that other activation devices may be utilized such as a contact switch positioned in the path of travel between the frame portions 20, 22 to be activated during their movement from storage to use attitudes. Not only is such alarm of positive value to signal an emergency situation so that other persons in the area may assist in rescue operations but can also serve as a theft preventative measure when supports of the present invention are positioned in sparsely attended locations such as outdoor motel swimming pools and the like.

While there is shown and described herein certain specific structure embodying the invention, it will be manifest to those skilled in the art that various modifications of the parts may be made without departing from the spirit and scope of the underlying inventive concept and that the same is not limited to the particular forms herein shown and described except insofar as indicated by the scope of the appended claims.

What is claimed is:

1. A combination support for a relatively rigid life ring and its associated retrieval line comprising, a frame adapted for mounting in a generally vertical disposition and having upper and lower portions each having an outwardly extending member adapted for retaining contact with portions of said ring, each of said frame portions having means for engaging portions of said line when said line is coiled about said frame, said frame portions being vertically movable with respect to each other from an open extended storage position wherein said line is relatively taut to a closed use position wherein said portions are relatively proximal to each other and said line is loosely supported thereby.

2. The support set forth in claim 1 wherein said life ring is disposed between said retaining members and wherein said members contact outer peripheral portions of said ring to maintain said frame in said open storage position.

3. The support as set forth in claim 2 wherein said lower portion is fixed and said upper portion is vertically slidable relative thereto.

4. The support set forth in claim 3 wherein said frame portions each include inner and outer surfaces, said inner surfaces adapted for proximal disposition in said closed frame position, said outer surfaces of said frame portions each of a smooth uninterrupted configuration for receipt of portions of said coiled line maintained thereon by the outward bias exerted thereagainst by said ring in said storage position.

5. The support as set forth in claim 4 wherein each of said outer frame surfaces adapted for receipt of said coiled line includes a rearwardly disposed outwardly extending line retaining ridge wherein said life ring in said storage position rearwardly biases those portions of said coiled line intermediate said outer frame surfaces so as to in turn urge said line against said retaining ridge.

6. The support set forth in claim 5 wherein said outer surfaces of said frame are each provided with a peripheral groove for receipt of opposed portions of said coiled line.

7. The support set forth in claim 4 wherein the line receiving outer surface and the ring retaining member of each frame portion are disposed in contiguous relationship with each other, said retaining member in part forming the forward portion of said outer surface and projecting forwardly of said frame so as to retain said ring in the frame storage position forwardly of said frame portions.

8. The support as set forth in claim 4 wherein said lower frame portion includes a slide member upwardly projecting from the inner surface thereof for slidable cooperation with a channel upwardly extending into said upper frame portion from the inner surface thereof.

9. The support as set forth in claim 8 wherein said slide member includes a plurality of openings projecting through the forward face thereof for receipt of fastening means so as to mount said frame, said channel in said upper frame member being open at the rear face thereof and inwardly rearwardly disposed at each side thereof for cooperation with a similarly configured slide member to prevent relative forward movement therebetween.

10. The support as set forth in claim 1 including alarm means mounted on one of said frame portions to indicate its movement from a storage to a use position.

11. The support as set forth in claim 4 including alarm means to indicate the movement of said frame from a storage to use position comprising an audible signal device and power source therefor mounted on said frame and an actuation device therefore, said actuation device disposed on the inner surface of said lower frame portion for contact by the inner surface of said upper frame portion.

12. The support as set forth in claim 7 wherein the inner surface of each retaining member is forwardly inwardly angled to present a forward surface thereof of greater cross sectional thickness than remaining portions thereof so as to increase the frictional engagement therebetween with outer peripheral portions of said life ring as said life ring is moved from storage to use positions.

13. The support as set forth in claim 7 wherein the forward terminus of each ring retaining member includes an inwardly projecting retaining lip for contact with forward peripheral portions of said ring.

* * * * *